US007309053B2

(12) United States Patent
Lin

(10) Patent No.: US 7,309,053 B2
(45) Date of Patent: Dec. 18, 2007

(54) HANGING MODULE ASSEMBLY FOR FRAMES

(75) Inventor: Ching-Yi Lin, Changhua Hsien (TW)

(73) Assignee: Lin Kun Ta Industrial Co., Ltd., Changhua Hsien (TW)

( * ) Notice: Subject to any disclaimer, the term of this patent is extended or adjusted under 35 U.S.C. 154(b) by 0 days.

(21) Appl. No.: 11/373,173

(22) Filed: Mar. 13, 2006

(65) Prior Publication Data

US 2007/0210234 A1 Sep. 13, 2007

(51) Int. Cl.
*A47G 1/24* (2006.01)
*B60R 1/02* (2006.01)

(52) U.S. Cl. ..... 248/476; 248/475.1; 248/466

(58) Field of Classification Search ..... 248/466, 248/475.1, 477, 480, 476; 38/102.1, 102.4; 403/402; 160/381
See application file for complete search history.

(56) References Cited

U.S. PATENT DOCUMENTS 878,680 A * 2/1908 Snell ..... 248/466
1,908,147 A * 5/1933 Hoegger ..... 248/489
2,204,862 A * 6/1940 Lehman ..... 248/466
3,630,476 A * 12/1971 Lococo ..... 248/476
3,830,278 A * 8/1974 Packer ..... 160/378
4,290,710 A * 9/1981 Waller ..... 403/306
4,478,006 A * 10/1984 Johnson, Jr. ..... 49/410
4,641,807 A * 2/1987 Phillips ..... 248/480
6,719,260 B1 * 4/2004 Hart ..... 248/479

* cited by examiner

*Primary Examiner*—Amy J. Sterling
(74) *Attorney, Agent, or Firm*—Rabin & Berdo, P.C.

(57) ABSTRACT

A hanging module assembly for frames having four frame moldings comprises a hanging bracket, a fixing plate, four circular through holes separately disposed at two adjacent sides of the fixing plate, a pressing portion disposed at the middle of the fixing plate and sunken towards a frame molding, four penetrating holes separately disposed on four sides of the hanging bracket, a face portion protruded from the middle of the hanging bracket and having a cross-shaped through hole. After a transparent plate, a picture, and a board are placed in concave edges of the frame moldings, the circular through holes and penetrating holes are secured into an internal thread hole at distal ends of two adjacent frame moldings by bolts, such that the pressing portion presses and fixes the board, and the cross-shaped through hole of the hanging bracket is mounted onto a wall by screws for simple and quick installations.

1 Claim, 6 Drawing Sheets

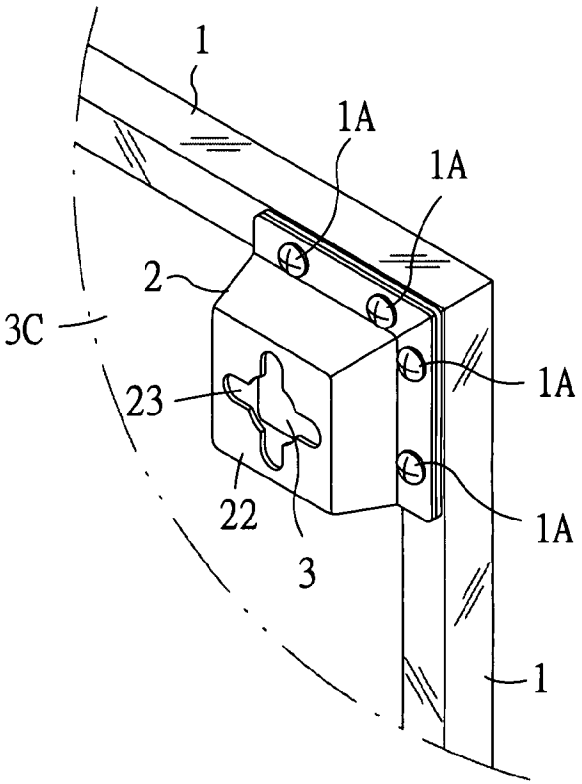
FIG. 1-B
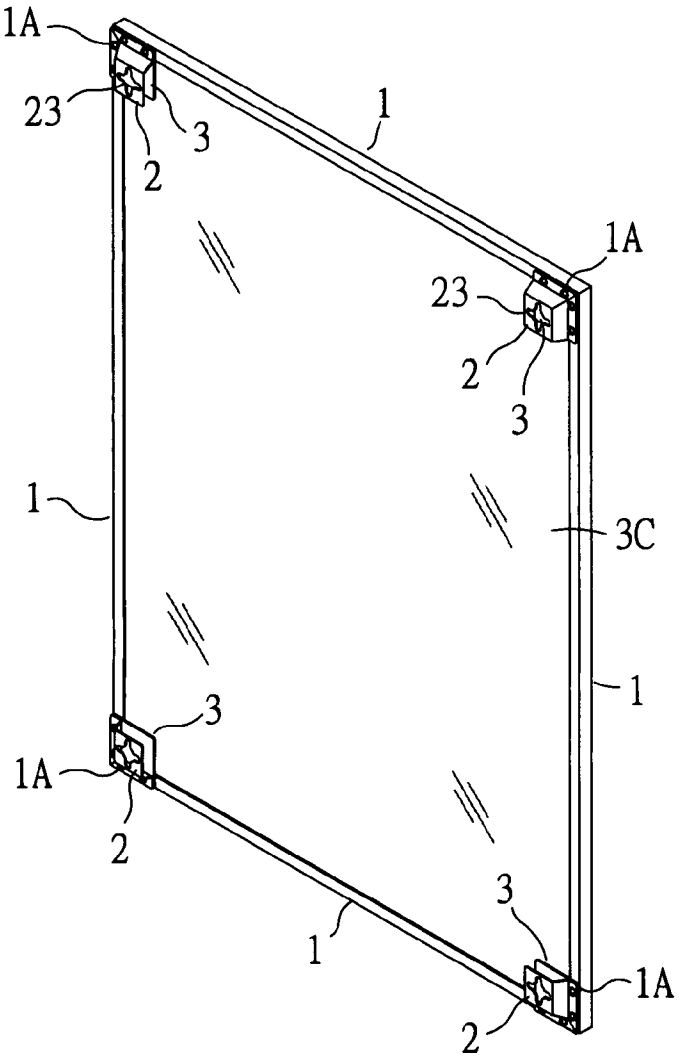
FIG. 1-A

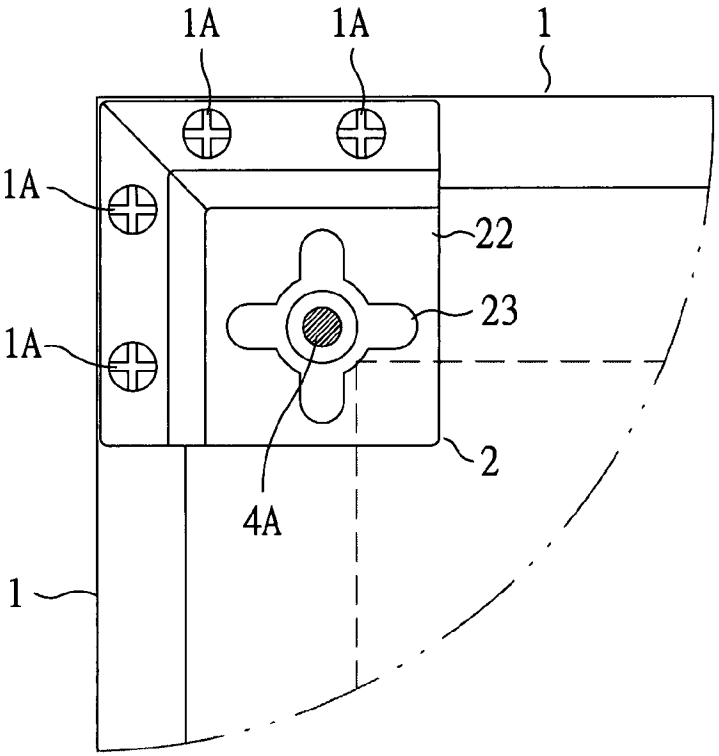
FIG. 4-B
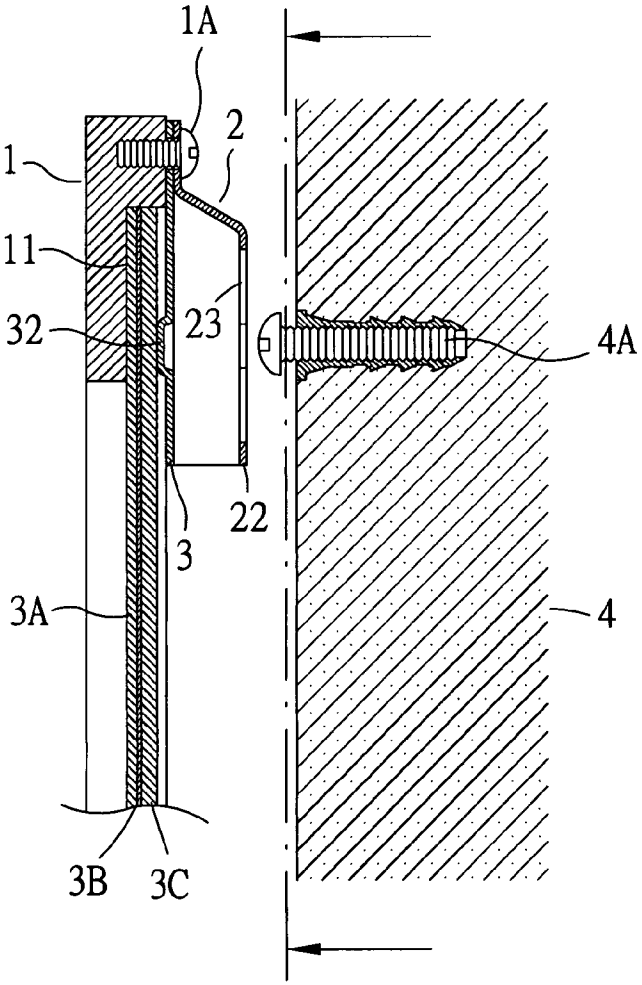
FIG. 4-A

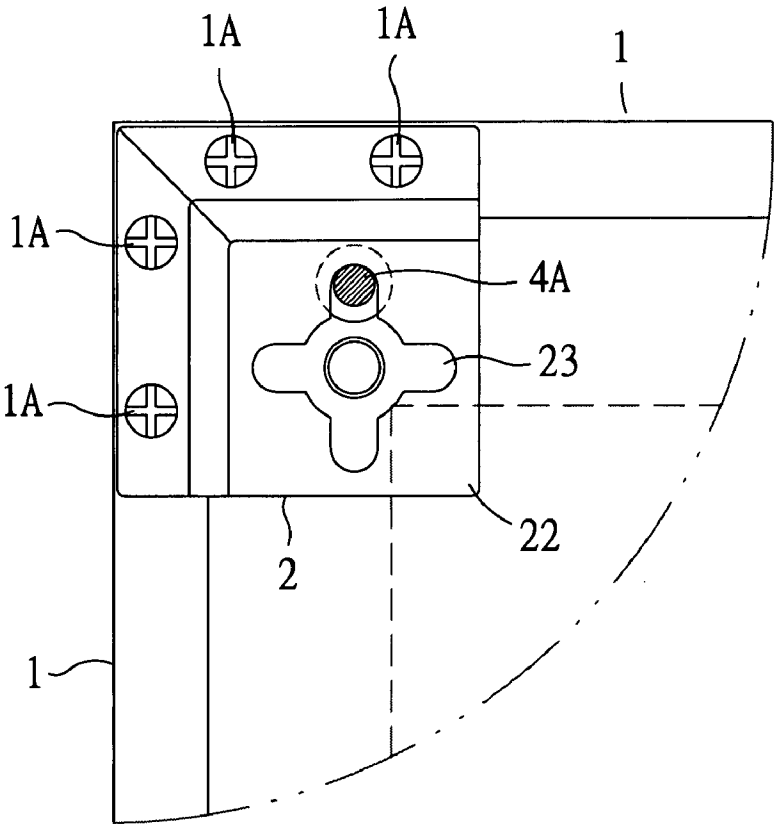
FIG. 5-B
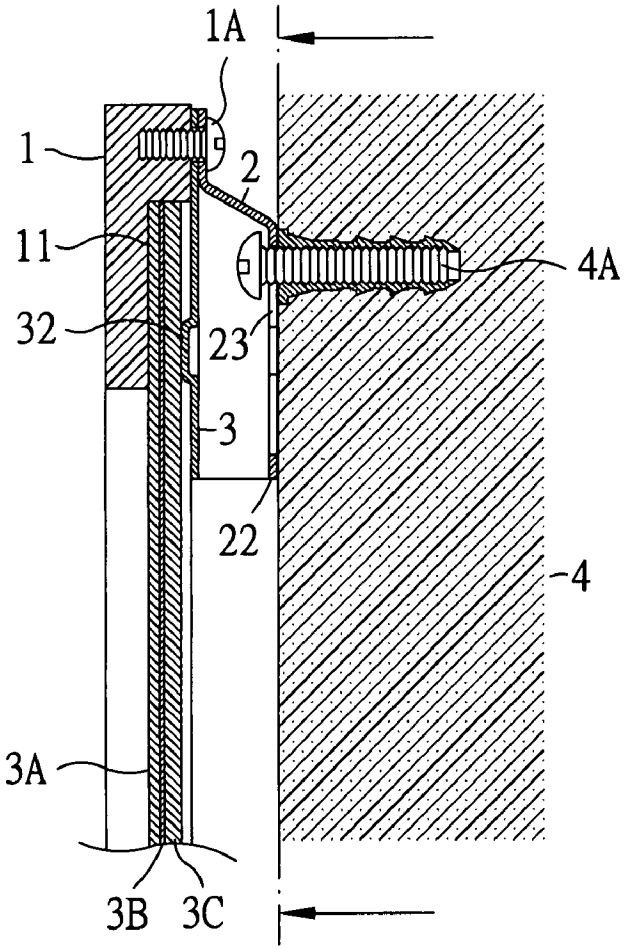
FIG. 5-A

HANGING MODULE ASSEMBLY FOR FRAMES

BACKGROUND OF THE INVENTION

1. Field of the Invention

The present invention relates to a hanging module assembly for frames, and more particularly to a hanging module that provides a convenient, easy, simple, and quick installation of a frame.

2. Description of the Related Art

As the traditional way of installing general frames is inconvenient and the frames usually require an installation of accessories on the frame first or repeated installations and removals of parts, and thus wasting much time and efforts on finding out how to install the frame. Furthermore, some accessories must be installed in a specific direction. If the accessories are installed in the wrong direction, the frame will be shaken or loosened easily, and thus the installation of traditional frames is very troublesome and inconvenient.

SUMMARY OF THE INVENTION

In view of the foregoing shortcomings of the prior art, the inventor of the present invention based on years of experience to conduct extensive researches and experiments to overcome the shortcomings, and finally invented a hanging module assembly for frames in accordance with the present invention.

Therefore, it is a primary objective of the present invention to provide a hanging module assembly for frames, and the hanging module assembly comprises a hanging bracket, a fixing plate, four circular through holes separately disposed at two adjacent sides of the fixing plate, a pressing portion disposed at the middle of the fixing plate and sunken towards a frame moulding, four penetrating holes separately disposed that the sides of the hanging bracket, a face portion protruded from the middle of the hanging bracket, and a cross-shaped through hole disposed on the face portion, thereby after a transparent plate, a picture, and a board are placed in concave edges in the four frame mouldings, the hanging module is secured into the internal thread holes disposed at the distal ends of the frame mouldings by a plurality of screw bolts, and the pressing portion of each fixing plate presses and fixes the board, and the cross-shaped through hole on the face portion of the hanging bracket is fixed onto a wall by screws, so as to provide a convenient, simple, easy, and quick installation.

BRIEF DESCRIPTION OF THE DRAWINGS

FIG. 1A is a perspective view of the structure of the invention;

FIG. 1B is an enlarged of a portion of the structure of the invention;

FIG. 4A is a schematic view of hanging the structure of the invention;

FIG. 4B is another schematic view of hanging the structure of the invention;

FIG. 5A is a schematic view of the hanged structure of the invention;

FIG. 5B is another schematic view of hanged structure of the invention;

DETAILED DESCRIPTION OF THE PREFERRED EMBODIMENTS

The present invention will now be described in more detail hereinafter with reference to the accompanying drawings that show various embodiments of the invention.

Figure 2:
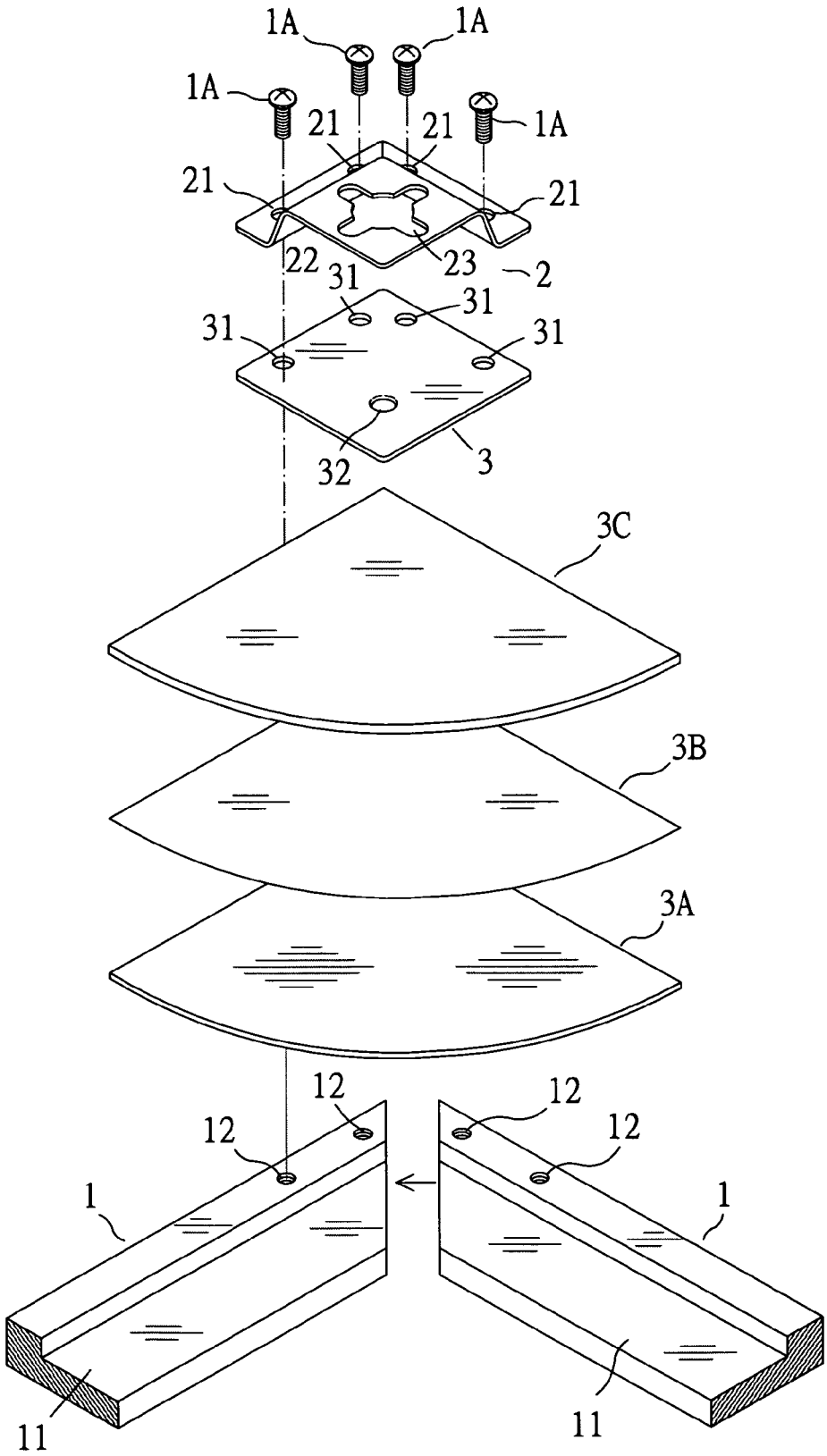
FIG. 2 is an exploded view of the structure of the invention.

Refer to FIGS. 1A, 1B and 2, a hanging module assembly for frames is installed at four positions of every two adjacent frame mouldings 1, and the hanging module comprises a hanging bracket 2 and a fixing plate 3, and the fixing plate 3 includes four circular through holes 31 separately disposed on the periphery of the fixing plate 3 and a pressing portion 32 disposed at the middle of the fixing plate 3 and sunken towards the frame moulding 1, and the hanging bracket 2 includes four penetrating holes 21 at the periphery of the hanging bracket 2 and a face portion 22 protruded from the middle of the hanging bracket 2, and the face portion 22 includes a cross-shaped through hole 23.

Figure 3:
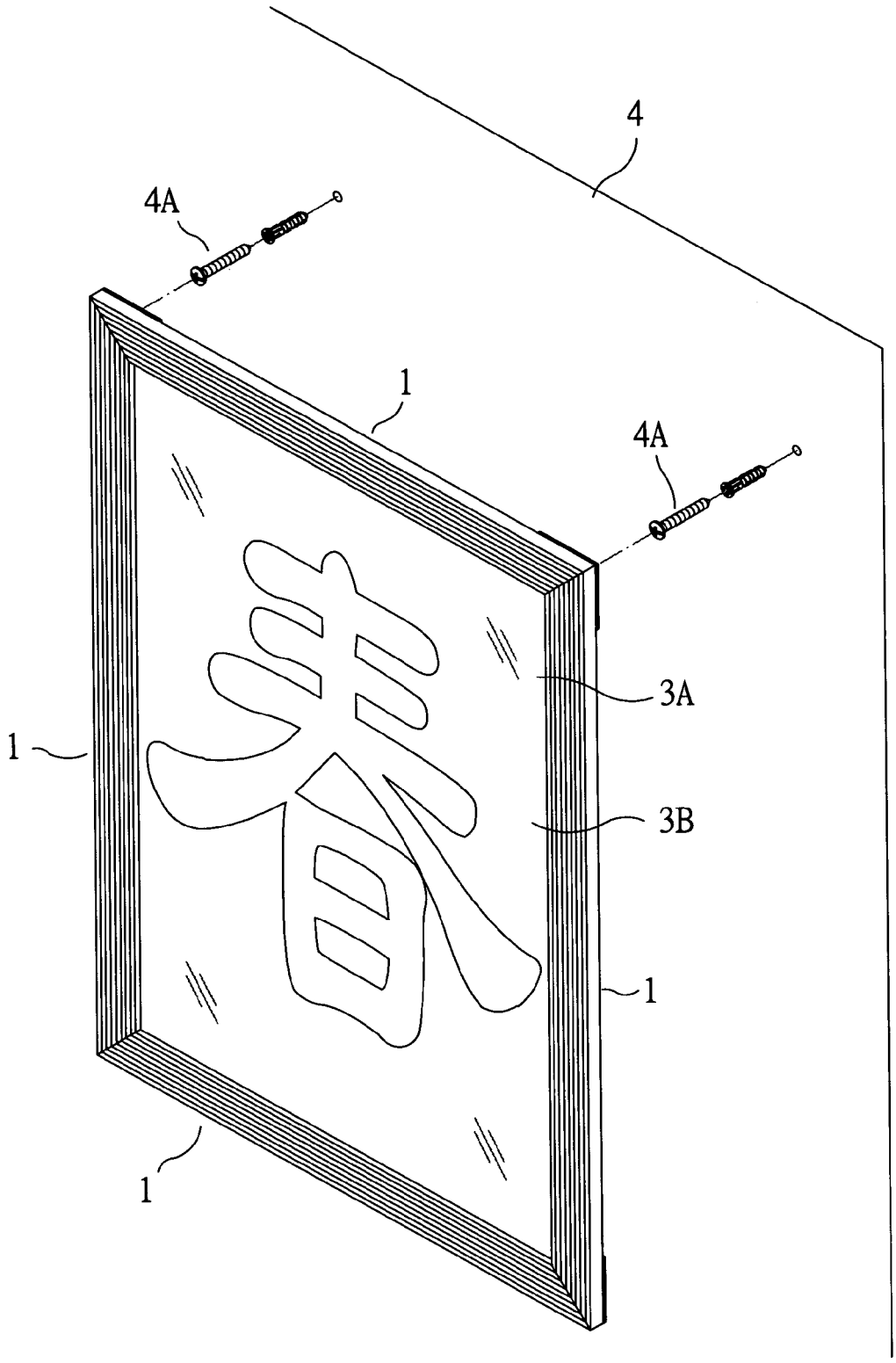
FIG. 3 is a front view of the structure of the invention.

After a transparent plate 3A, a picture 3B and a board 3C are placed sequentially in the concave edges 11 of the four frame mouldings 1 of the frame, the four edges are placed on top of the fixing plate 3 and the hanging bracket 2, and the circular through holes 31 and the penetrating holes 21 are aligned with the internal thread holes 12 at the distal end of the frame mouldings 1 and secured to the internal thread hole 12 by a plurality of screw bolts 1A after the screw bolts 1A pass through the circular through holes 31 and the penetrating holes 21, such that the pressing portion 32 of each fixing plate 3 presses against a board 3C to fix the transparent plate 3A, picture 3B, and board 3C into the concave edges 11 of the frame mouldings 1 (as shown in FIGS. 1A and 3) and then fixed onto a predetermined position of the wall 4 by screws 4A (as shown in FIG. 3). After the cross-shaped through hole 23 of the face portion 22 in the hanging bracket 2 of the frame is installed to the screw 4A on a wall 4 (as shown in FIGS. 4A and 4B), and the frame is released so that the frame droops due to the weight of the frame, and the screws 4A on the wall 4 latches the top of the cross-shaped through hole 23 to constitute the hanging condition (as shown in FIGS. 5A and 5B), so as to provide an effective way for a convenient, simple, easy and quick installation.

Figure 7:
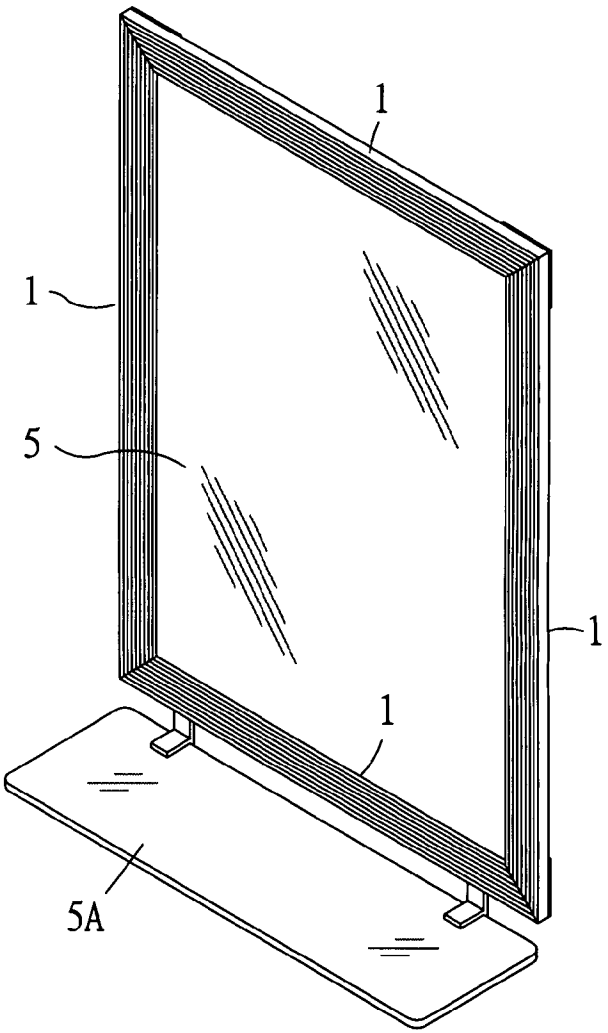
FIG. 7 is a schematic view of the invention in the state of a mirror.
Figure 6:
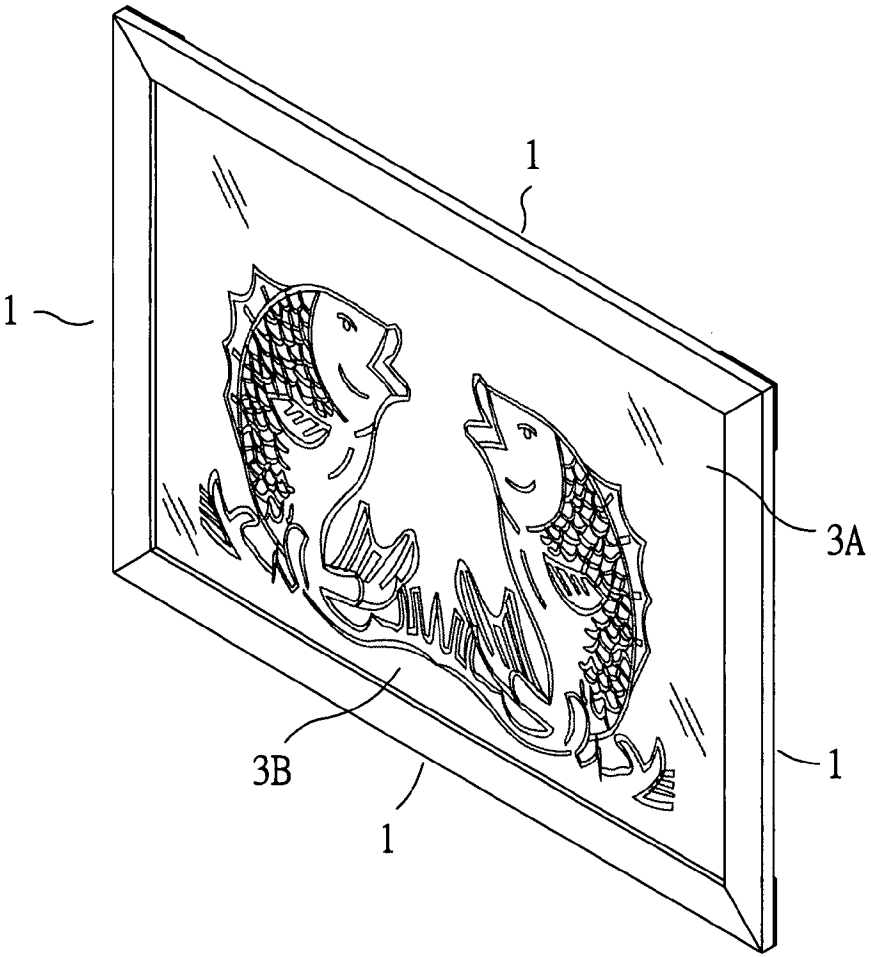
FIG. 6 is a schematic view of hanging the structure at another angle according to the present invention.

Of course, the frame can be hanged transversally (as shown in FIG. 6) or used as a mirror surface 5 to go with a panel surface 5A at the bottom to constitute a dressing table (as shown in FIG. 7), so as to provide various different applications.

In summation of the above description, the present invention herein enhances the performance than the conventional structure and further complies with the patent application requirements and is submitted to the Patent and Trademark Office for review and granting of the commensurate patent rights.

While the invention has been described by means of specific embodiments, numerous modifications and variations could be made thereto by those skilled in the art without departing from the scope and spirit of the invention set forth in the claims.

What is claimed is:

1. A hanging module assembly for frames, each installed separately at four positions where two adjacent frame mouldings are coupled, and said hanging module assembly comprising a hanging bracket and a fixing plate, wherein said fixing plate includes four circular through holes separately disposed at two adjacent sides of said fixing plate, and a pressing portion disposed at the middle of said fixing plate and sunken towards a frame moulding; and said hanging bracket includes four penetrating holes disposed separately on four sides of said hanging bracket, and a face portion protruded from the middle of said hanging bracket, and said face portion includes a cross-shaped through hole; thereby after a transparent plate, a picture, and a board are placed into concave edges of said four frame mouldings, said four circular through holes and said four penetrating holes are secured into an internal thread hole disposed at a distal end of said frame moulding by a plurality of screw bolts, and said pressing portion of said each fixing plate presses and fixes said board, and said cross-shaped through hole at said face portion of said hanging bracket is fixed onto a wall by a plurality of screws, so as to achieve a simple, easy, and quick installation.

* * * * *